US006196232B1

(12) United States Patent
Chkadua

(10) Patent No.: US 6,196,232 B1
(45) Date of Patent: Mar. 6, 2001

(54) MAGNETIC SMOKING PIPE

(76) Inventor: Gocha Chkadua, 3732 42$^{nd}$ Ave. South, Minneapolis, MN (US) 55406

( * ) Notice: Subject to any disclaimer, the term of this patent is extended or adjusted under 35 U.S.C. 154(b) by 0 days.

(21) Appl. No.: 09/260,207

(22) Filed: Mar. 1, 1999

(51) Int. Cl.[7] ..... A24F 5/00; A24F 7/02; A24F 13/02; A24F 1/10

(52) U.S. Cl. ..... 131/222; 131/225; 131/192; 131/178; 131/330; D27/163; D27/180

(58) Field of Search ..... 131/330, 174, 131/176, 178, 180, 192, 222, 225, 333; D27/163, 165, 180, 187

(56) References Cited

U.S. PATENT DOCUMENTS

| | | | | |
|---|---|---|---|---|
| D. 231,414 | * | 4/1974 | Bills | D27/163 |
| 3,116,739 | * | 1/1964 | Andonie | 131/225 |
| 4,730,626 | | 3/1988 | Calkins . | |
| 5,826,638 | * | 10/1998 | Jelic | 160/107 |
| 5,850,838 | | 12/1998 | Sigrist . | |

* cited by examiner

*Primary Examiner*—Stanley S. Silverman
*Assistant Examiner*—Dionne A. Walls
(74) *Attorney, Agent, or Firm*—Patterson, Thuente, Skaar & Christensen, P.A.

(57) ABSTRACT

The smoking pipe of the present invention generally includes a base and a mouthpiece. The base includes a bowl for placement of loose tobacco and also includes a channel that extends from the bowl out the front of the base. The base further includes a permanent magnet that is embedded within the base and located above the channel. The mouthpiece is a component that is separate and distinct from the base. The mouthpiece includes a channel that extends the full length of the mouthpiece. Further, the mouthpiece incorporates a permanent magnet that is embedded within the mouthpiece and located above the channel. The mouthpiece is generally movable between two positions relative to the base. The first is a smoking position where the mouthpiece is held tight to the base such that the channels of the mouthpiece and base are aligned for smoking. The second is a transportation position in which the mouthpiece is held tight to the base such that the mouthpiece covers the bowl maintaining any loose tobacco within. The smoking pipe is of minimal dimensions allowing for the pipe to be easily carried within the palm of the hand or a shirt or pants pocket.

16 Claims, 2 Drawing Sheets

MAGNETIC SMOKING PIPE

FIELD OF THE INVENTION

The present invention relates to smoking accessories and, more particularly, to pipes used for smoking.

BACKGROUND OF THE INVENTION

Smoking pipes typically include a bowl that is connected to a mouthpiece via a conduit. The bowl holds loose tobacco, that when lit by fire, can be made to smoke by drawing air through the mouthpiece. As the fire consumes the tobacco, a combination of tobacco and ashes remain in the bowl. Eventually, the fire consumes the tobacco and only ashes are left in the bowl. However, smokers often only consume a portion of the tobacco leaving a situation wherein the bowl must be emptied or capped off in some fashion.

Some smoking pipes do indeed provide a cover for the bowl, allowing the smoker to resume smoking at his/her desire without the necessity of having to carry a pouch full of tobacco to refill the bowl. Thus, a cover allows the smoker to engage in multiple smoking sessions without reloading the bowl, and, without losing tobacco and/or ashes from the bowl. The cover allows the smoker to transport the pipe, however, this is not done with great ease or comfort as most pipes are too large and bulky to fit within a shirt or pants pocket.

As such, there is a need for a compact pipe that may be capped and easily carried within a smoker's pocket. Since the pipe will be carried in a pocket, it is important that the cap not be easily removed by a mere jarring to the pocket.

SUMMARY OF THE INVENTION

The needs and concerns described above are in large measure solved by a smoking pipe of the present invention. The smoking pipe of the present invention generally includes a base and a mouthpiece. The base includes a bowl for placement of loose tobacco and also includes a channel that extends from the bowl out the front of the base. The base further includes a permanent magnet that is embedded within the base and located above the channel. The mouthpiece is a component that is separate and distinct from the base. The mouthpiece includes a channel that extends the full length of the mouthpiece. Further, the mouthpiece incorporates a permanent magnet that is embedded within the mouthpiece and located above the channel. The mouthpiece is generally movable between two positions relative to the base. The first is a smoking position where the mouthpiece is held tight to the base such that the channels of the mouthpiece and base are aligned for smoking. The second is a transportation position in which the mouthpiece is held tight to the base such that the mouthpiece covers the bowl maintaining any loose tobacco within. The smoking pipe is of minimal dimensions allowing for the pipe to be easily carried within the palm of the hand or a shirt or pants pocket.

The mouthpiece and the base are each preferably fabricated of aluminum and each preferably incorporate a step portion. Of course, numerous other materials, such as wood or brass, may be used without departing from the spirit or scope of the invention. The step portions are manufactured such that when the mouthpiece is in the transportation position, the step portions mate with each other and help to prevent the sliding of the mouthpiece atop the base. The mouthpiece and base are preferably provided with neodymium magnets of sufficient strength such that when the mouthpiece is lifted to an angle of 30–45° above the base, the attraction of the magnets draws the mouthpiece down into alignment with the base to enable smoking. Likewise, when the mouthpiece is lifted from its open, or smoking, position to an angle approximately 30–45° above the base, the attraction of the magnets draws the mouthpiece down atop the base.

DESCRIPTION OF THE DRAWINGS

FIG. 7 depicts the mouthpiece at an angle relative to the base that will allow the mouthpiece to be drawn to the closed position or to the open position depending on which way the mouthpiece is being lifted.

DESCRIPTION OF THE PREFERRED EMBODIMENT

Figures 1, 2, 3, 4:
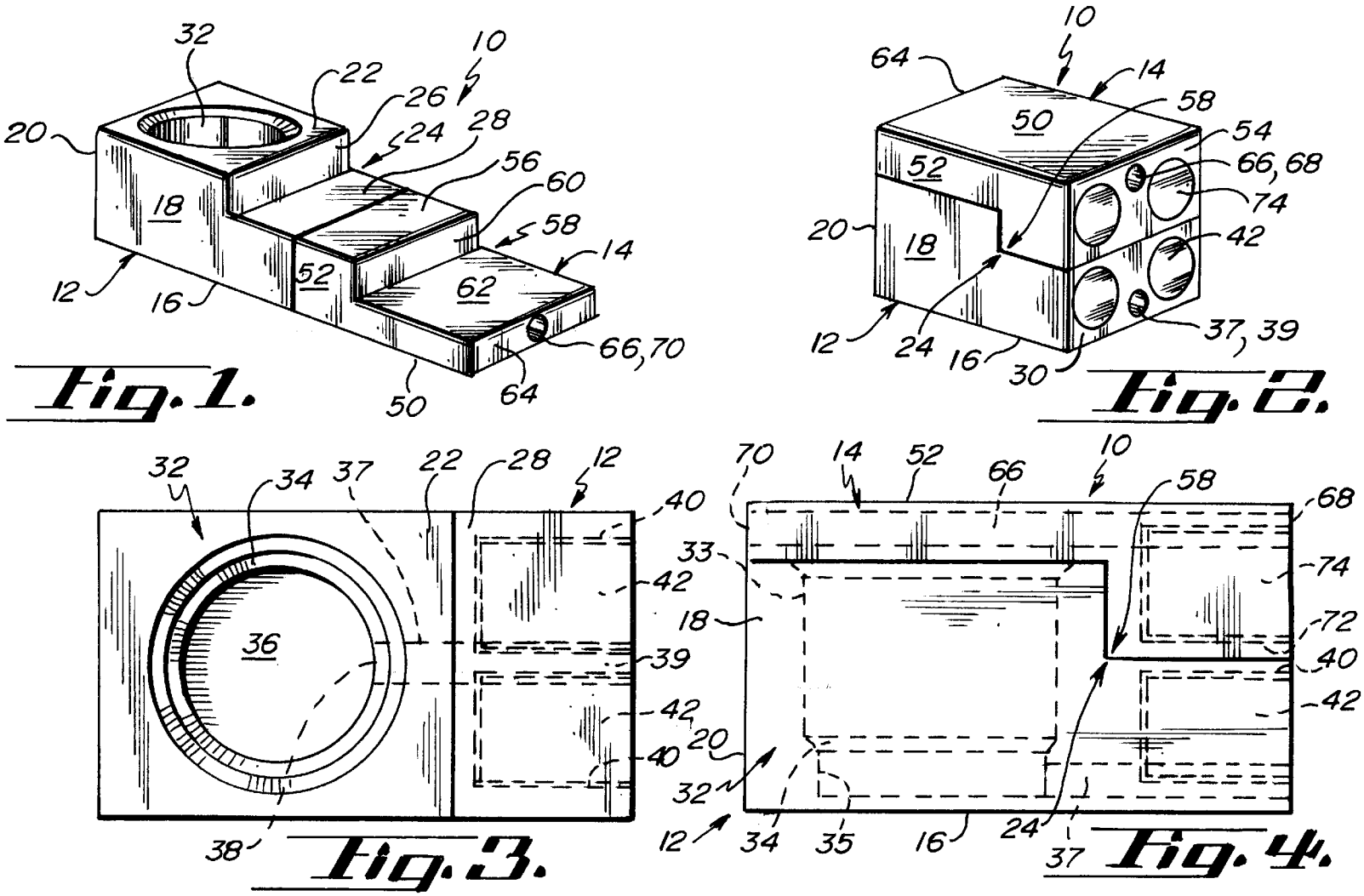
FIG. 1 is a front perspective of a magnetic smoking pipe of the present invention in its open, smoking position.
FIG. 2 is a rear perspective of the magnetic smoking pipe in its closed, transportable position.
FIG. 3 is a top plan view of a base of the smoking pipe of the present invention.
FIG. 4 is a side elevation view of the base and a mouthpiece of the smoking pipe of the present invention.
Figure 6:
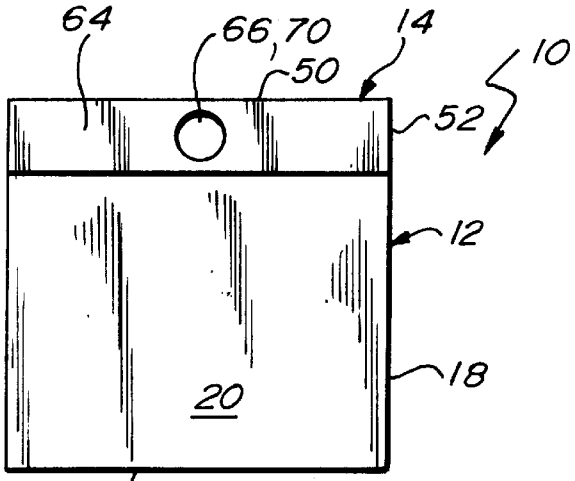
FIG. 6 is a rear elevation view of the base and mouth piece of the smoking pipe of the present invention.
Figure 5:
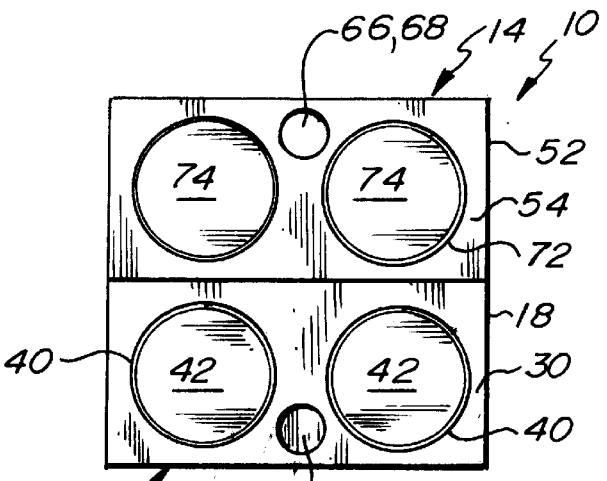
FIG. 5 is a front elevation view of the base and mouthpiece of the smoking pipe of the present invention.
Figure 4:
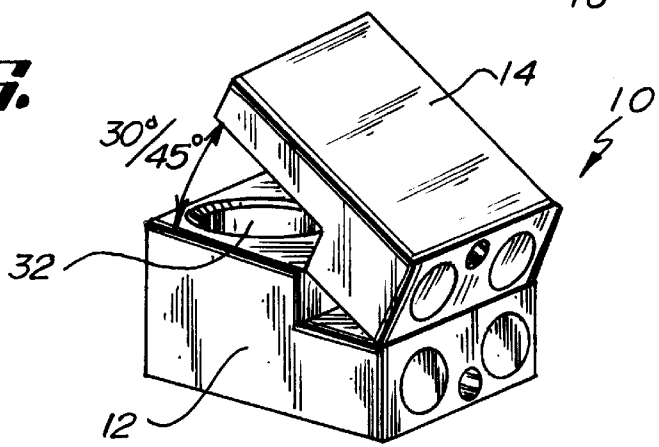

A smoking pipe 10 of the present invention is depicted in FIG. 1 and generally includes a base 12 and a mouthpiece 14. In a desire to present the preferred embodiment, base 12 and mouthpiece 14 will be described with reference to specific dimensions, however, it should be noted that other dimensions may be used without departing from the spirit or scope of the invention.

FIGS. 1–6 depict base 12. Base 12 is preferably fabricated from 60/61 Aluminum, a grade of aluminum that is generally corrosion resistant and non-magnetic. Of course, numerous other materials, such as wood or brass, may be used without departing from the spirit or scope of the invention. Base 12 includes a bottom face 16 that is substantially planar. Two side faces 18 extend substantially perpendicularly upward from bottom face 16 and are joined together by rear face 20, a substantially planar surface, and top face 22, also a substantially planar surface. Base 12 additionally includes a step portion 24. Step portion includes a side face portion 26 which extends perpendicularly to a top face portion 28, a substantially planar surface. Top face portion 28 is joined to bottom face 16 by front face 30. Preferred dimensions find bottom face 16 having a length of approximately 1.1 inches and a width of approximately 0.6 inches. Side faces 18 have a height of approximately 0.6 inches at top face 22 and a height of approximately 0.3 inches at top face portion 28. Top face portion 28 has a length of approximately 0.4 inches and a width of approximately 0.6 inches.

Generally centered within top face 22 is a bowl 32. Bowl 32 preferably includes an upper portion 33, a rim portion 34, a lower portion 35 and a bottom portion 36. Upper portion 33 is generally cylindrical in nature, preferably having a diameter of approximately 0.5 inches and a height of approximately 0.4 inches. Upper portion 33 extends from top face 22 to rim portion 34. Rim portion 34 serves to narrow the diameter of bowl 32 from approximately 0.5 inches to approximately 0.4 inches. Maintaining the diameter of approximately 0.4 inches, lower portion 35, which is generally cylindrical in nature, extends approximately 0.1 inches from rim portion 34 to bottom portion 36 Bottom portion 36 is a substantially planar surface. A channel 37, which is preferably cylindrical in shape, extends from a first opening 38 in lower portion 35 to a second opening 39 in front face 30. As such, channel 37 is preferably slightly less than 0.1 inches in diameter and is approximately 0.5 inches in length. The center of channel 37 is preferably located at approximately 0.07 inches up from bottom face 16 and approximately 0.3 inches in from either of side faces 18.

A pair of apertures 40 extend approximately 0.3 inches from front face 30 rearward. Apertures 40 are preferably cylindrical in shape and have a diameter of approximately 0.25 inches. The center of each aperture 40 is located approximately 0.2 inches up from bottom face 16 and approximately 0.17 inches over from its respective side face 18. A magnet 42 is preferably inserted within each aperture 40. Magnets 42 are preferably nickel plated, neodymium magnets having grade NEO27 that are approximately 0.25 inches in diameter and approximately 0.25 inches in length. Of course, other types of permanent magnets may be used without departing from the spirit or scope of the invention. Magnets 42 are preferably retained within apertures 40 with a retaining compound, e.g. LOCTITE® 609 retaining compound. Of course, other manners of retaining magnets 42 within apertures 40 may be used without departing from the spirit or scope of the invention.

Mouthpiece 14 is depicted in FIGS. 1–2 and 4–6. Like base 12, mouthpiece 14 is preferably fabricated from 60/61 aluminum, a grade of aluminum that is generally corrosion resistant and non-magnetic. Of course, numerous other materials, such as wood or brass, may be used without departing from the spirit or scope of the invention. Mouthpiece 14 includes a bottom face 50, which is substantially planar surface, and two side faces 52 which extend perpendicularly upward from bottom face 50. Side faces 52 are joined by a substantially planar rear face 54 and substantially planar top face 56. Mouthpiece 14 also includes a step portion 58. Step portion 58 has a side face portion that extends perpendicularly from top face 56 to a top face portion 62. A substantially planar front face 64 extends perpendicularly between top face portion 62 and bottom face 50. Preferred dimensions find bottom face 50 having a length of approximately 1.1 inches and a width of approximately 0.6 inches. Side faces 52 have a height of approximately 0.4 inches at top face 56 and a height of approximately 0.1 inches at top face portion 62. Top face portion 62 has a length of approximately 0.7 inches and a width of approximately 0.6 inches.

A channel 66, that is preferably cylindrical in nature, extends from a first opening 68 in rear face 54 to a second opening 70 in front face 64. Channel 66 preferably has a diameter of approximately 0.1 inches and has its center located at approximately 0.07 inches up from bottom face 50 and 0.3 inches in from each side face 52.

A pair of apertures 72 extend approximately 0.3 inches from rear face 54 forward. Apertures 72 are preferably cylindrical in shape and have a diameter of approximately 0.25 inches. The center of each aperture 72 is located approximately 0.2 inches up from bottom face 50 and approximately 0.17 inches over from its respective side face 52. A magnet 74 is preferably inserted within each aperture 72. Magnets 74 are preferably nickel plated, neodymium magnets having grade NEO27 that are approximately 0.25 inches in diameter and approximately 0.25 inches in length. Of course, other types of permanent magnets may be used without departing from the spirit or scope of the invention. Magnets 74 are preferably retained within apertures 72 with a retaining compound, e.g. LOCTITE® 609 retaining compound. Of course, other manners of retaining magnets 74 within apertures 72 may be used without departing from the spirit or scope of the invention.

As stated earlier base 12 and mouthpiece 14 are separate and distinct pieces that may be joined together solely by magnetic attraction, no hinges or other type of connection is required. In its closed, or transportable position, as shown in FIG. 2, mouthpiece 14 of smoking pipe 10 lies atop base 12. In the closed position, step portion 24 of base 12 mates with step portion 58 of mouthpiece 14. Step portions 24 and 58 help to prevent mouthpiece 14 from sliding towards rear face 20 of base 12, and aids in the substantial alignment of front face 64 with rear face 20. Additionally, in the closed position top face 56 of mouthpiece 14 covers bowl 32, allowing tobacco (not shown) to be transported within smoking pipe 10. Mouthpiece 14 is retained tightly to ba se 12 by virtue of the magnetic attraction of magnets 42 and magnets 74 to each other. The attraction of magnets 42 and 74 also acts to substantially prevent any side-to-side movement of mouthpiece 14 atop base 12.

To place smoking pipe in its open, or smokable, position as shown in FIG. 1. One need only raise mouthpiece 14 to an angle of approximately 30–45° up from its position atop base 12, see FIG. 7; only a single finger need be used to raise mouthpiece 14. At this point, the strength of magnets 42 and 74 take over and mouthpiece 14 is drawn downward and into substantial alignment with base 12. In the open position, top face portion 28 and top face portion 62 are proximate each other and are substantially flush across. Magnets 42 and magnets 74 are located substantially, directly across from each other, and channel 37 and channel 66 are in substantial alignment creating, essentially, a single channel from bowl 32 to front face 64 of mouthpiece 14. Tobacco (not shown) may be placed in bowl 32 and lit. A user may smoke by placing mouthpiece 14 to the mouth and drawing through channels 37 and 66.

To place smoking pipe 10 once again into its closed, or transportable position, one need only press upward on bottom face 50 of mouthpiece 14 to raise mouthpiece 14 to a desired angle, i.e. 30–45° off of top face 22, see the desired angle indicated on FIG. 7. At this point, the strength of magnets 42 and magnets 74 once again take over drawing mouthpiece 14 down atop base 12 in substantial alignment with base 12. Using the dimensions as described above produces a smoking pipe that may be easily slipped into the palm of the hand or pocket of a user in both the open or closed position. Transporting in the closed position allows the user to retain loose tobacco within bowl 32 and also helps to prevent mouthpiece 14 from separating from base 12 during transportation.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed:

1. A smoking pipe comprising:

a base having a bowl and a communication channel; and a mouthpiece having a communication channel wherein said mouthpiece is magnetically attachable to said base in at least a first position and a second position, wherein when said mouthpiece is magnetically attached to said base in said first position the strength of the magnetic attachment holds said communication channel of said base and said communication channel of said mouthpiece in substantial alignment, and wherein when said mouthpiece is magnetically attached to said base in said second position said mouthpiece covers said bowl and the strength of the magnetic attachment provides substantial alignment of said mouthpiece on said base in said second position.

2. The smoking pipe of claim 1, wherein said base includes at least one magnet.

3. The smoking pipe of claim 2, wherein said magnet comprises a neodymium magnet.

4. The smoking pipe of claim 1, wherein said mouthpiece includes at least one magnet.

5. The smoking pipe of claim 4, wherein said magnet comprises a neodymium magnet.

6. The smoking pipe of claim 1, wherein said base and said mouthpiece are fabricated from a material selected from the group consisting of aluminum, wood and brass.

7. The smoking pipe of claim 1, wherein said base includes a step portion and wherein said mouthpiece includes a step portion.

8. The smoking pipe of claim 7, wherein said step portion of said base mates with said step portion of said mouthpiece when said mouthpiece is attached to said base in said second position.

9. A smoking pipe comprising:

means for holding tobacco, wherein said means for holding tobacco includes means for magnetic joining; and means for inhaling, wherein said means for inhaling includes means for magnetic joining, wherein said means for magnetic joining of said means for inhaling attracts said means for magnetic joining of said means for holding tobacco whereby said means for inhaling is magnetically attachable to said means for holding tobacco in at least two positions wherein in a first position said means for holding tobacco is magnetically held by said means for magnetic joining in a side-by-side alignment with said means for inhaling and wherein in a second position said means for holding tobacco is magnetically held by said means for magnetic joining in a top-to-bottom alignment with said means for inhaling.

10. The smoking pipe of claim 9, wherein said means for holding tobacco and said means for inhaling is fabricated from a material selected from the group consisting of aluminum, wood and brass.

11. The smoking pipe of claim 9, wherein said means for magnetic joining of said means for holding tobacco comprises at least one neodymium magnet.

12. The smoking pipe of claim 9, wherein said means for magnetic joining of said means for inhaling comprises at least one neodymium magnet.

13. A smoking pipe comprising:

a base having a bowl, a communication channel and at least one magnet; and a mouthpiece having a communication channel and at least one magnet, wherein said mouthpiece is magnetically attachable to said base in at least a first position and a second position, and when said mouthpiece is magnetically attached to said base in said first position said communication channel of said base and said communication channel of said mouthpiece are in substantial alignment, and when said mouthpiece is magnetically attached to said base in said second position said mouthpiece covers said bowl;

wherein said base includes a first mating portion and said mouthpiece includes a second mating portion;

wherein said first mating portion mates with said second mating portion when said mouthpiece is attached to said base in said second position; and wherein the strength of the magnets provide substantial alignment of said mouthpiece on said base in said second position.

14. The smoking pipe of claim 13, wherein said at least one magnet of said base comprises a neodymium magnet.

15. The smoking pipe of claim 13, wherein said at least one magnet of said mouthpiece comprises a neodymium magnet.

16. The smoking pipe of claim 13, wherein said first mating portion comprises a step portion and wherein said second mating portion comprises a step portion.

* * * * *